US007882964B2

(12) United States Patent
Battaglia

(10) Patent No.: US 7,882,964 B2
(45) Date of Patent: Feb. 8, 2011

(54) APPARATUS AND METHOD FOR UTILIZING A GRAVITY FEED HANGER

(75) Inventor: Joe Battaglia, Frisco, TX (US)

(73) Assignee: Frito-Lay North America, Inc., Plano, TX (US)

( * ) Notice: Subject to any disclaimer, the term of this patent is extended or adjusted under 35 U.S.C. 154(b) by 697 days.

(21) Appl. No.: 11/832,346

(22) Filed: Aug. 1, 2007

(65) Prior Publication Data

US 2009/0032482 A1 Feb. 5, 2009

(51) Int. Cl.
*A47F 5/08* (2006.01)

(52) U.S. Cl. ..... 211/59.1; 211/7; 211/87.01; 211/183; 248/220.22; 248/302

(58) Field of Classification Search ..... 211/87.01, 211/54.1, 57.1, 59.1, 7, 51, 85.9, 193, 13.1, 211/183; 248/220.22, 220.31, 220.41, 302, 248/304

See application file for complete search history.

(56) References Cited

U.S. PATENT DOCUMENTS

| | | | | | |
|---|---|---|---|---|---|
| 2,842,264 | A * | 7/1958 | Larson | 206/526 |
| 3,612,459 | A * | 10/1971 | Walls | 248/215 |
| 3,908,949 | A * | 9/1975 | Larson | 248/220.43 |
| 4,094,415 | A * | 6/1978 | Larson | 211/57.1 |
| 4,674,721 | A * | 6/1987 | Thalenfeld | 248/220.22 |
| 4,688,683 | A * | 8/1987 | Thalenfeld et al. | 211/57.1 |
| 4,762,299 | A * | 8/1988 | Langelier | 248/220.22 |
| 4,801,116 | A * | 1/1989 | Blankenship | 248/220.22 |
| 5,109,992 | A * | 5/1992 | Miller | 211/59.1 |
| 5,441,161 | A * | 8/1995 | Merl | 211/57.1 |
| 5,984,118 | A * | 11/1999 | Morrow | 211/59.1 |
| 6,349,909 | B1 * | 2/2002 | Zarrow et al. | 248/220.41 |
| 6,502,706 | B1 * | 1/2003 | Kent | 211/87.01 |
| 6,601,808 | B1 * | 8/2003 | Nagel | 248/220.31 |
| 7,219,806 | B1 * | 5/2007 | Morrow | 211/59.1 |
| 7,322,138 | B2 * | 1/2008 | Gormley et al. | 40/658 |
| 7,426,997 | B2 * | 9/2008 | Nagelski | 211/57.1 |
| 7,484,628 | B2 * | 2/2009 | Schneider | 211/57.1 |
| 2003/0111433 | A1 * | 6/2003 | Park | 211/59.1 |
| 2003/0230688 | A1 * | 12/2003 | Hase et al. | 248/304 |
| 2005/0077257 | A1 * | 4/2005 | Ahlund et al. | 211/54.1 |
| 2007/0034581 | A1 * | 2/2007 | Weck et al. | 211/59.1 |
| 2008/0099417 | A1 * | 5/2008 | Zandt | 211/57.1 |
| 2008/0156749 | A1 * | 7/2008 | Shea | 211/7 |
| 2009/0095695 | A1 * | 4/2009 | Moock et al. | 211/57.1 |
| 2009/0294309 | A1 * | 12/2009 | Franco | 206/223 |

* cited by examiner

*Primary Examiner*—Darnell M Jayne
*Assistant Examiner*—Devin Barnett
(74) *Attorney, Agent, or Firm*—Bobby W. Braxton; Colin P. Cahoon; Carstens & Cahoon, LLP

(57) ABSTRACT

An apparatus and method for removably coupling a hanger to a latch at a first end of the hanger, removing the hanger from the latch while the latch remains coupled to a support member, threading an item of hanging stock onto the hanger via the first end, and recoupling the hanger to the latch while the latch remains coupled to the support member, wherein the hanger extends from the latch at an angle that is less than the horizontal, so that the hanging stock is urged by gravity toward a second end of the hanger.

15 Claims, 15 Drawing Sheets

APPARATUS AND METHOD FOR UTILIZING A GRAVITY FEED HANGER

BACKGROUND

The present disclosure relates in general to inventory management systems and in particular to gravity feed hangers for displaying and dispensing hanging stock.

DETAILED DESCRIPTION

Figure 1:
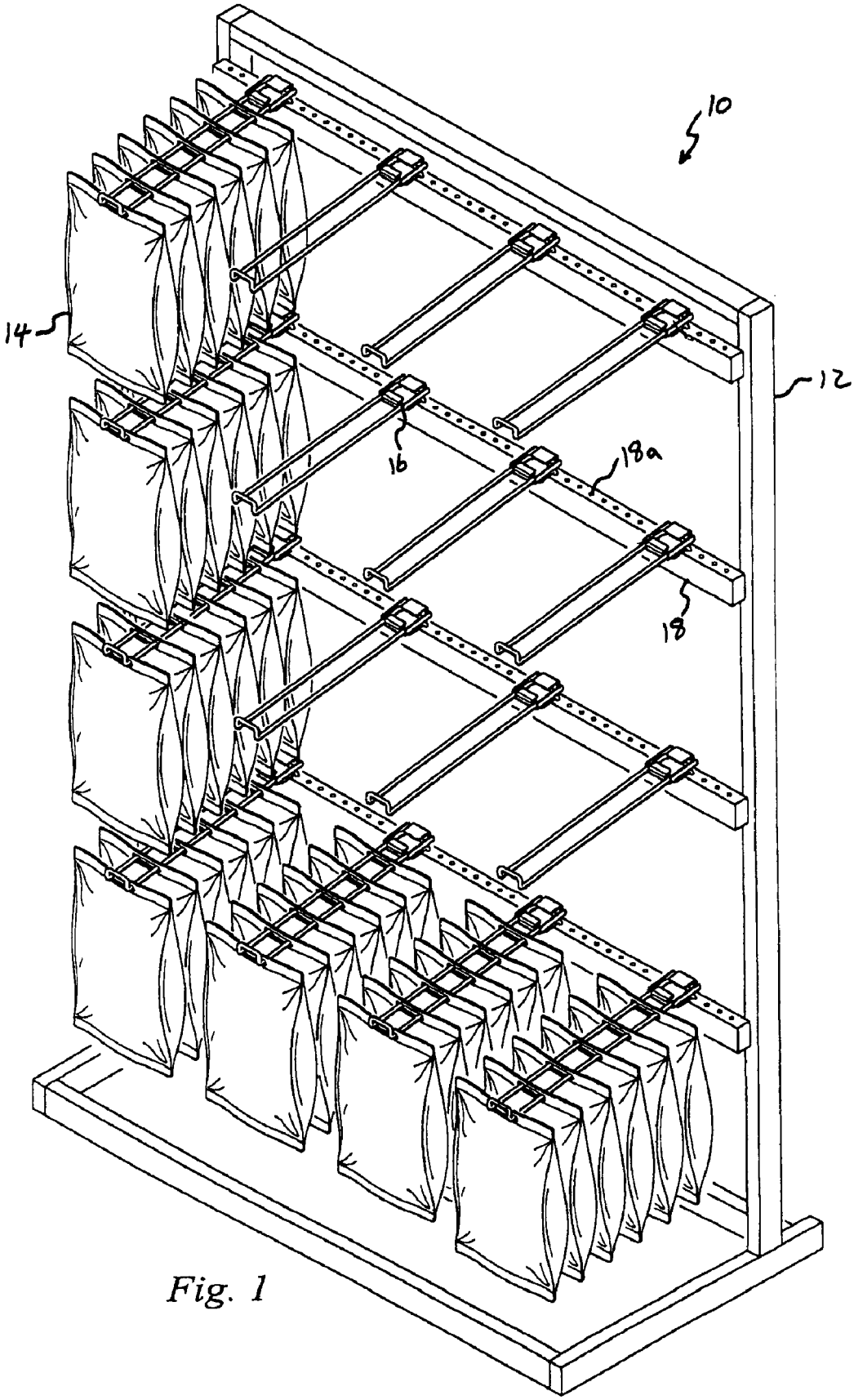
FIG. 1 is a perspective front view of a gravity feed system according to one embodiment of the present disclosure.

Referring to FIG. 1, a gravity feed system according to an embodiment of the invention is referred to, in general, by the reference numeral 10. The gravity feed system 10 includes a display apparatus 12 comprising a vertical member, upon and from which a multitude of hanging stock 14 may be displayed and dispensed, respectively. The hanging stock 14 are supported by multiple gravity feed hanger assemblies 16, which are in turn supported by crossbeams or support members 18.

Although the hanging stock 14 depicted in the Figs. includes average-sized flex-bags, which are most commonly suited to the marketing of snack foods, the gravity feed system 10 can be used to store and dispense other items packaged in bags, boxes, or other similar containers. As shown in FIG. 1, the hanging stock 14 engages the gravity feed hanger assembly 16 via a slot 20 formed in the hanging stock tab 22. In other embodiments, this engagement can be obtained through the use of a non-integral tab added to the hanging stock 14 prior to placement of the hanging stock 14 on the gravity feed hanger assembly 16. In still further embodiments, the hanging stock 14 may comprise an integral or attached hook for engaging the gravity feed hanger assembly 16.

The configuration of the gravity feed system 10 can be rearranged to suit a variety of sizes and shapes of hanging stock 14. In the embodiment shown in FIG. 1, the configuration of the gravity feed system 10 is determined by the vertical spacing of the crossbeams or horizontal members 18 and the horizontal spacing of the gravity feed hanger assemblies 16 along each crossbeam. In some embodiments, the crossbeams 18 are removably coupled with the upright portion of the display apparatus 12 so that the vertical position of each crossbeam 18 is adjustable along generally the entire length of the upright portions of the display apparatus 12. Each crossbeam 18 also contains a uniformly spaced linear array of vertically oriented receptacles 18*a* that extend though the crossbeam 18. The array of receptacles 18*a* extends substantially the length of the crossbeam 18.

Figure 2:
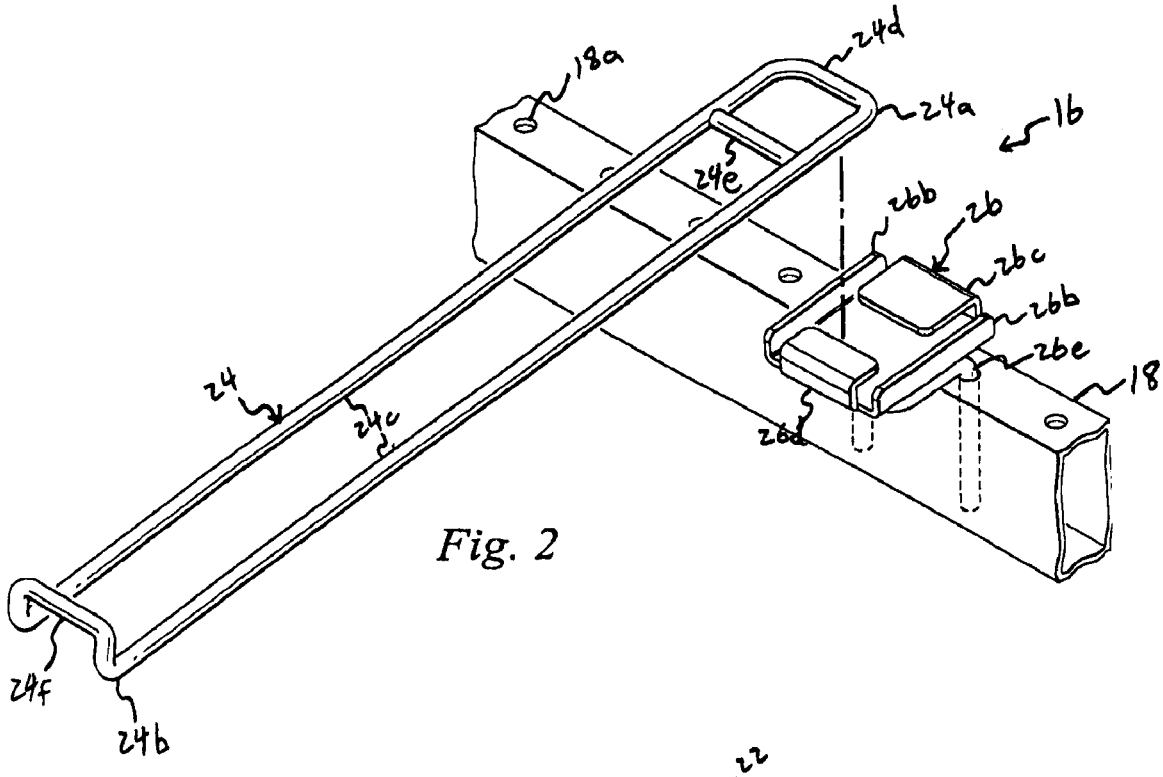
FIG. 2 is an enlarged perspective and exploded view of a gravity feed hanger assembly of the gravity feed system of FIG. 1.

Referring to FIG. 2, the gravity feed hanger assembly 16 comprises a hanger 24 and a latch 26 which are configured to be removably coupled together and, when so coupled, interact to support and dispense the hanging stock 14. The hanger 24 has a loading end 24*a* and a dispensing end 24*b* and includes a pair of parallel rods 24*c* that substantially define the length of the hanger 24. The amount of space between the rods 24*c* can be varied, based on the weight and dimensions of the hanging stock 14.

The hanger rods 24*c* are connected at the loading end 24*a* of the hanger 24 by an endpiece 24*d* that extends from the ends of each of the rods 24*c*. A crosspiece 24*e* similarly extends between the hanger rods 24, in parallel with the endpiece 24*d*, and is spaced from the endpiece 24*d* as required by the fit of the hanger 24 with the latch 26, described herein. In some embodiments, the hanger 24 may include only one of the endpiece 24*d* and the crosspiece 24*e*, or the endpiece 24*d* or the crosspiece 24*e* may not completely span the gap between the hanger rods 24*c*. Some embodiments of the hanger may possess rounded joints between the endpiece and the hanger rods, so as to facilitate insertion of the hanger in to the latch, as described herein.

The hanger rods 24*c* are connected at the dispensing end 24*b* by a lip 24*f* which curls upward. In some embodiments, the lip 24*f* bends back toward the rods 24*c* to form an angle of 90-degrees or less with the rods 24*c*. In some embodiments, the lip 24*f* is bent back such that it is substantially vertical. The hanger rods 24*c*, the lip 24*f* and the endpiece 24*d* can be formed from a single piece of material, such as wiring or molded plastic. In other embodiments, the components of the hanger 24 may be distinct and thus assembled to form the hanger 24.

Figure 3:
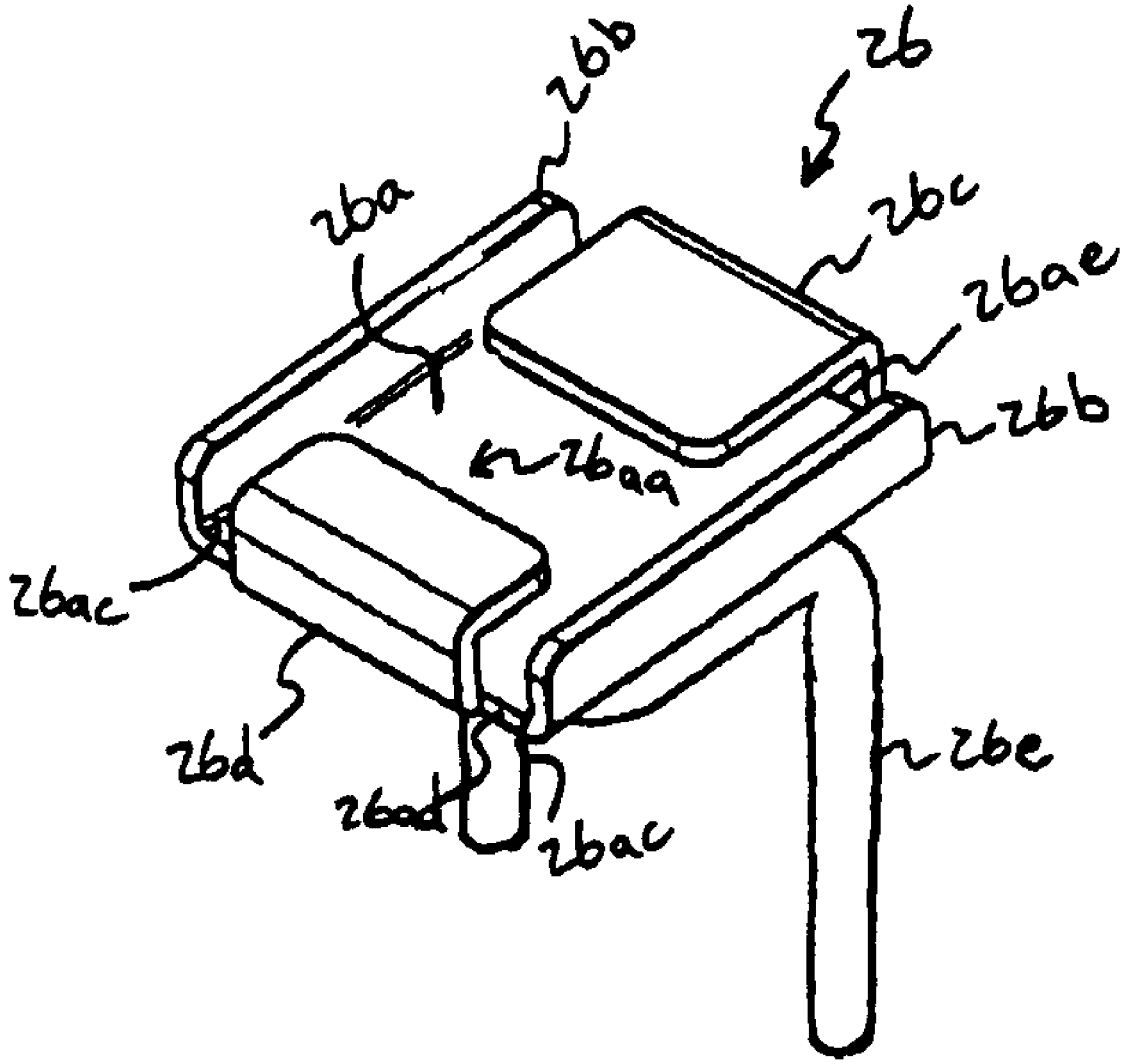
FIG. 3 is an enlarged perspective view of a latch of the gravity feed hanger assembly depicted in FIG. 2.

Referring to FIG. 3, with continuing reference to FIG. 2, the latch 26 of the gravity feed hanger assembly 16 includes a base 26*a*, two longitudinal side tabs 26*b*, a latitudinal load tab 26*c*, a latitudinal restraining tab 26*d*, and a pair of mounting members 26*e*. The base 26*a*, which is flat and rectangular, has a top face 26*aa*, which defines the plane along which the hanger 24 extends, a bottom face 26*ab*, side edges 26*ac*, a front edge 26*ad* and a rear edge 26*ae*. The side tabs 26*b* extend upward from the side edges 26*ac* of the base 26*a* to a height at least equal to the thickness of the rods 24*c*, so that the side tabs 26*b* are parallel to each other and perpendicular to the base 26*a*. The restraining tab 26*d* extends upward from the front edge 26*ad* of the base 26*a* to a height generally equal to that of the side tabs 26*b*, and then extends, parallel to the top face 26*aa* and toward the rear edge 26*ae* of the base 26*a*, for a distance at least equal to the thickness of the crosspiece 24*e*. The load tab 26*c* extends from the rear edge 26*ae* of the base 26*a* and mirrors the restraining tab 26*b* with the exception that the horizontal portion of the load tab 26*c* extends further, so that the gap between the load tab 26*c* and the restraining tab 26*b* is no greater than the space between the endpiece 24*d* and crosspiece 24*e* of the hanger 24.

Figure 12:
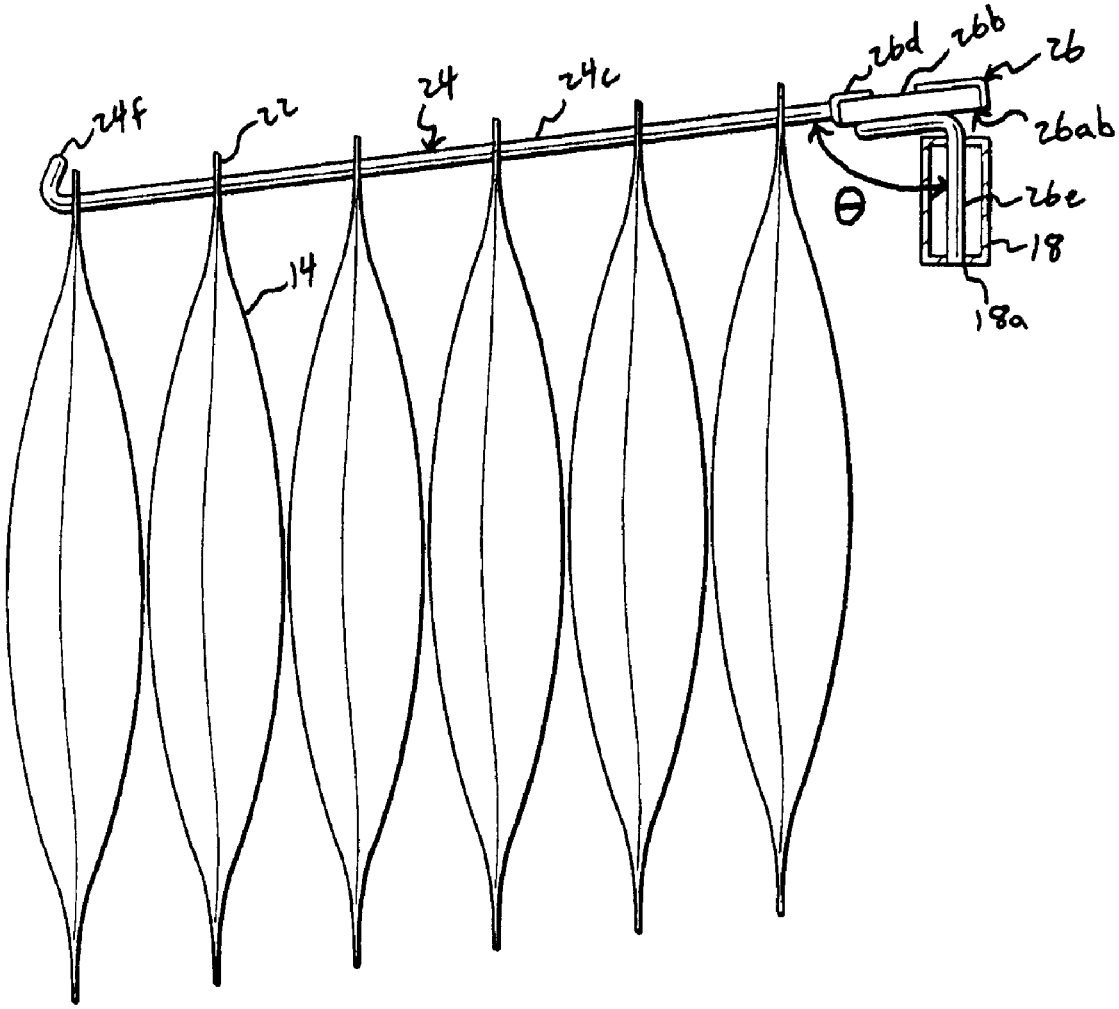
FIG. 12 is a side elevation of the loaded gravity feed assembly of FIG. 11.

The mounting members 26*e* extend in parallel from the bottom face 26*ab* of the base 26*a* at an angle dictated by the desired resting angle of the mounted gravity feed hanger assembly 16. As demonstrated by the embodiment illustrated in FIG. 12, the mounting members 26*e* may be angled, with respect to the bottom face 26*ab*, such that the hanger 24 extends away from the crossbeam 18 at a downward angle. In some embodiments, the hanger 24 extends from the crossbeam 18 such that an angle θ between the mounting members 26*e* and the hanger 24 is about 80 degrees. In other embodiments, the angle of the gravity feed hanger assembly 16 may be adjusted to be more level or more sloped with respect to a horizontal plane. The mounting members 26*e* may be distinct components or, as illustrated in FIGS. 2 and 12, they may both be formed from a single, continuous piece of material.

Figure 10:
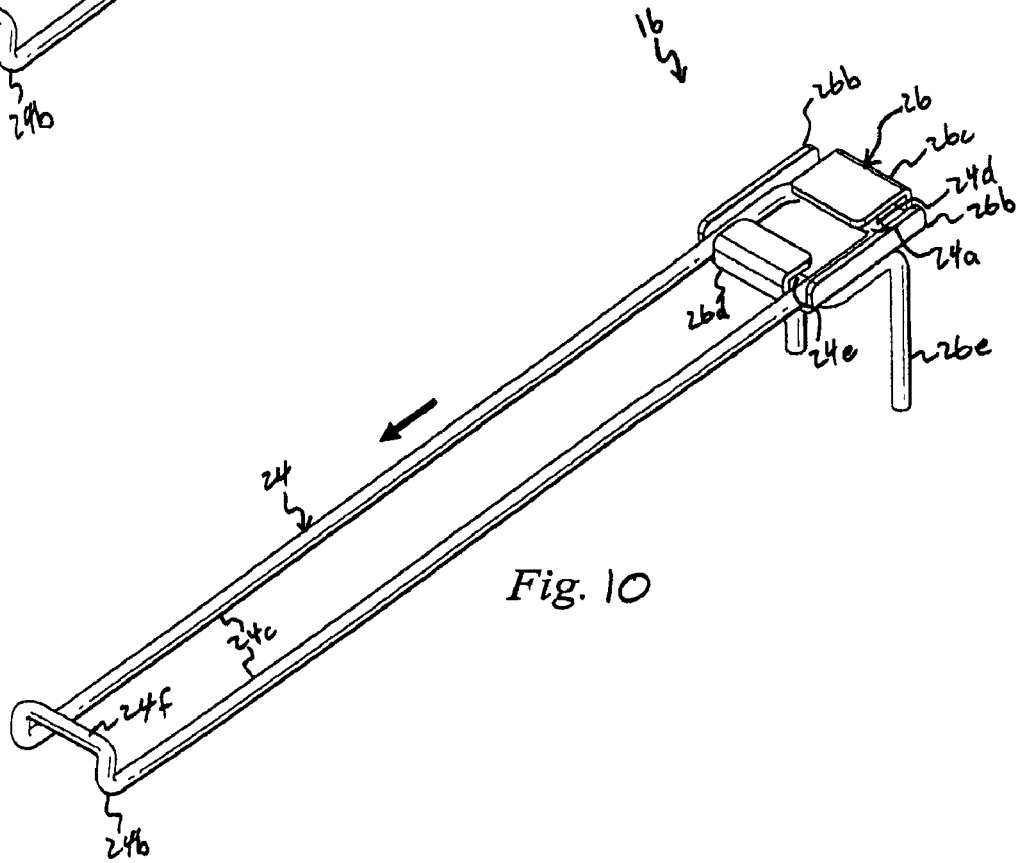
Figure 11:
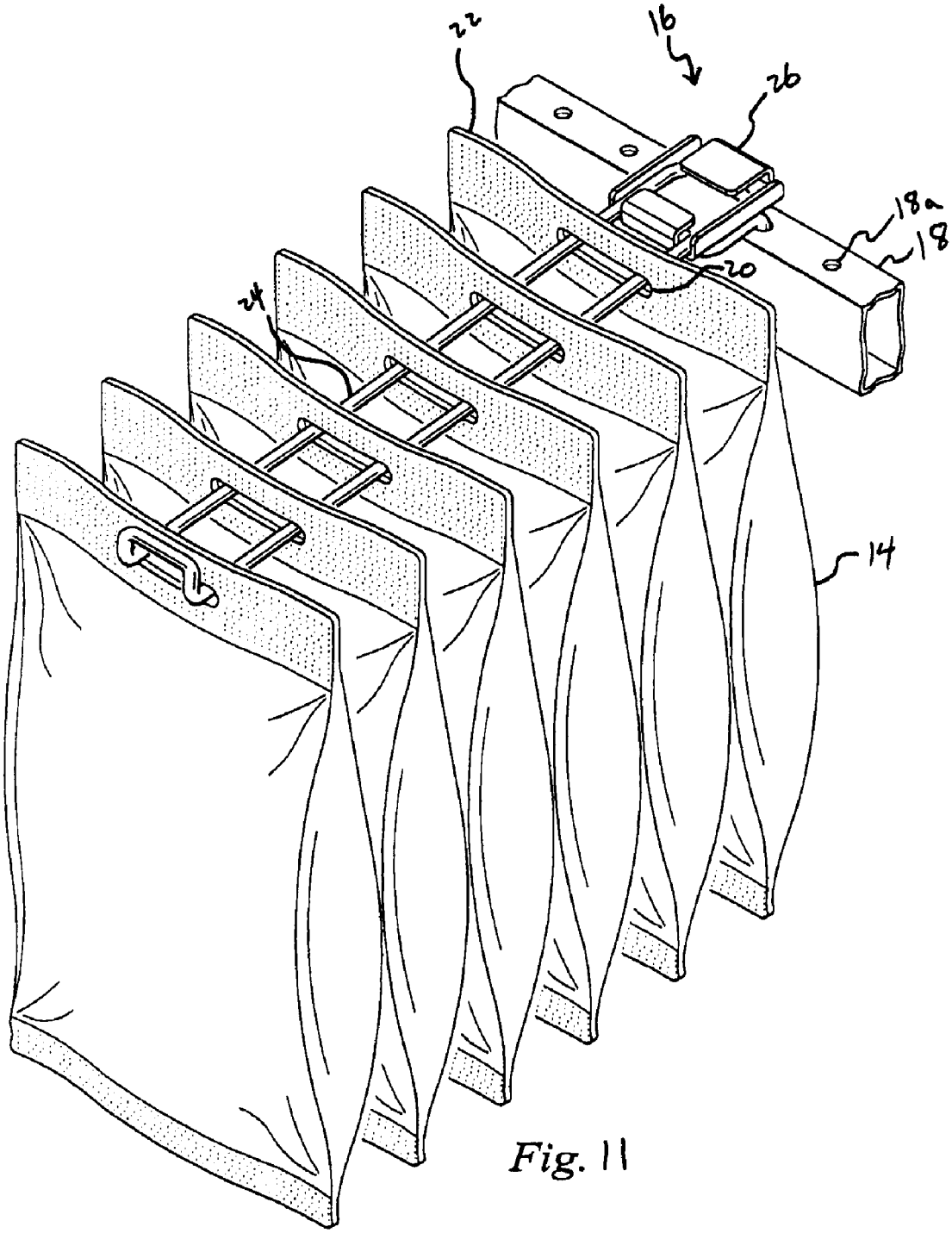
FIG. 11 is a perspective front view of the gravity feed assembly of FIG. 2, loaded with hanging stock.

When an embodiment of the gravity feed system 10 is in an assembled and installed condition, as shown in FIGS. 1 and 11, the gravity feed hanger assembly 16 is mounted on the crossbeam 18. As shown in FIGS. 2 and 12, the mounting members 26*e* are inserted into the receptacles 18*a* of the crossbeam 18 and extend substantially through the vertical length of the crossbeam 18, so that the latch 26 is stabilized against lateral and longitudinal movement. As demonstrated in FIGS. 10 and 11, the hanger 24 is coupled with the latch 26 such that the crosspiece 24*e* is substantially enclosed by the restraining tab 26*d*, the endpiece 24*d* is covered by the load tab 26*c*, and the rods 24*c* are flanked by the side tabs 26*b*. As illustrated by FIGS. 1 and 11, the gravity feed system 10 is thus suited to support the hanging stock 14 that is suspended from the hanger 24.

Figure 4:
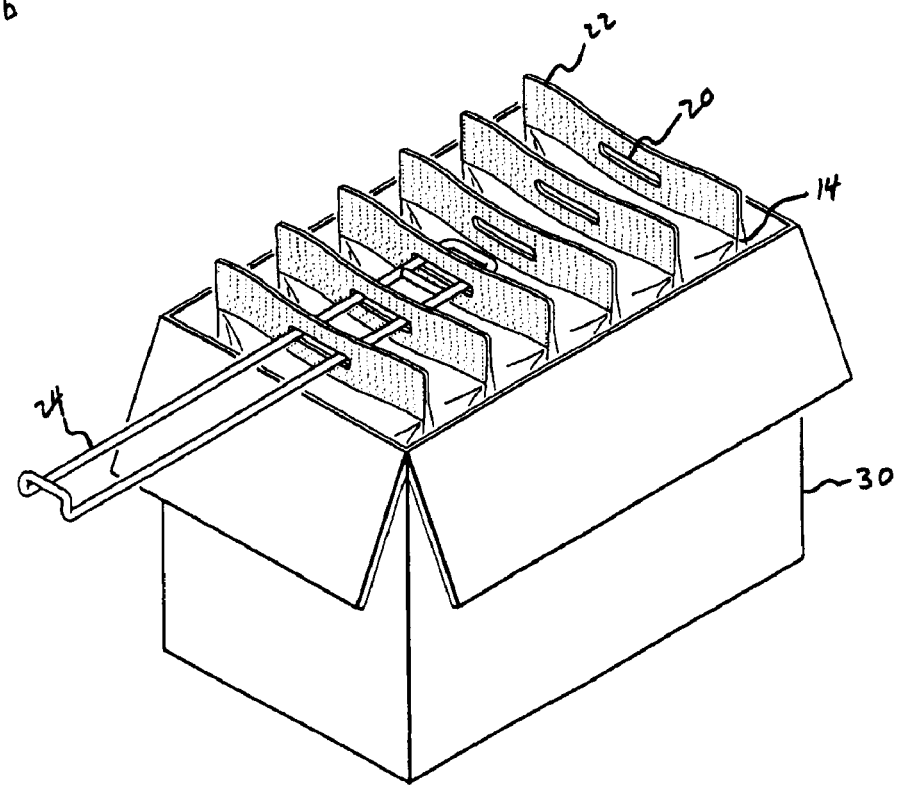
FIG. 4 is a perspective view of the hanger of FIG. 2 being threaded through hanging stock loaded in a stock container.
Figure 5:
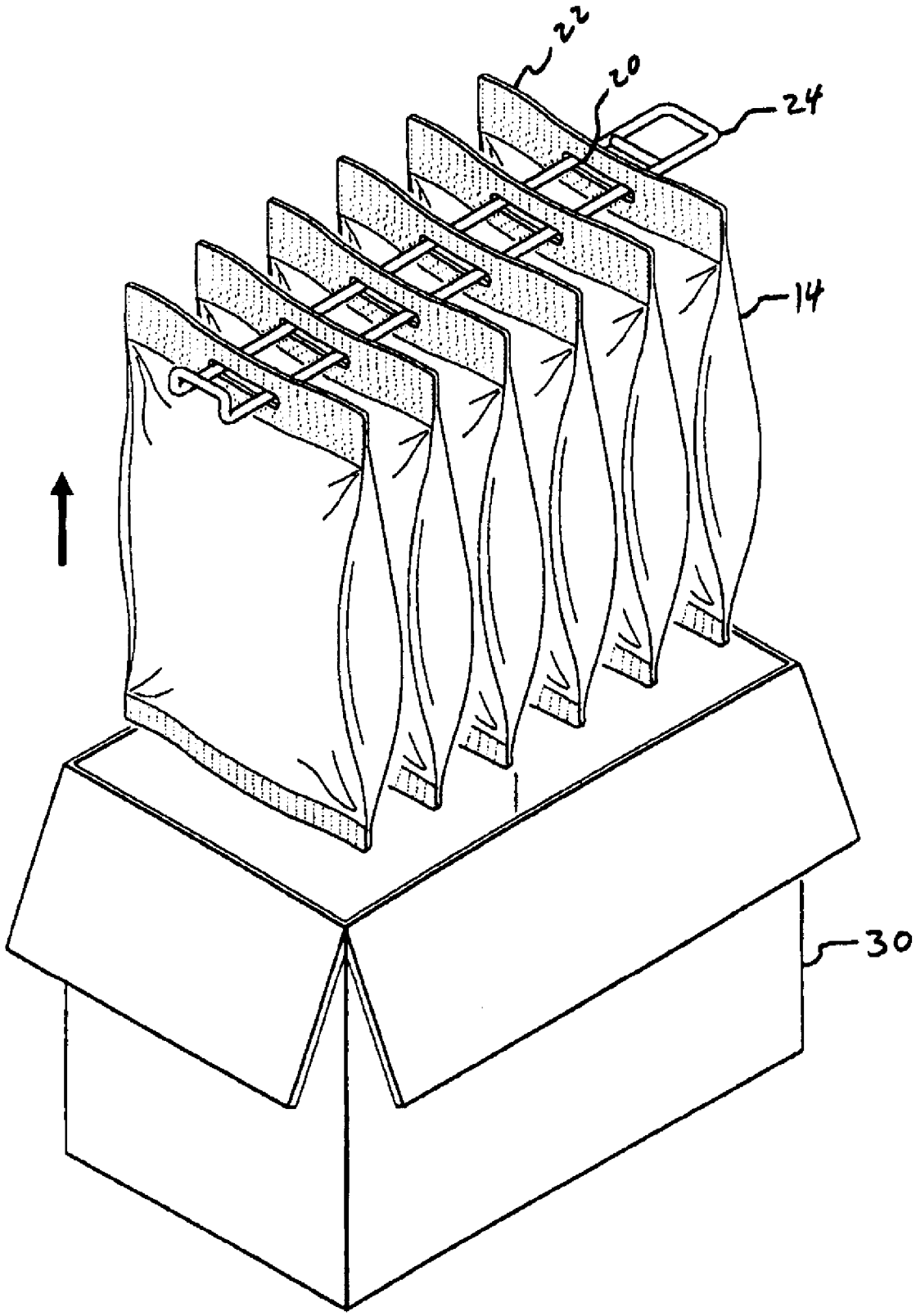
FIG. 5 is a perspective view of the hanging stock from FIG. 4 being removed from a stock container after being threaded onto the hanger of FIG. 2.
Figure 6:
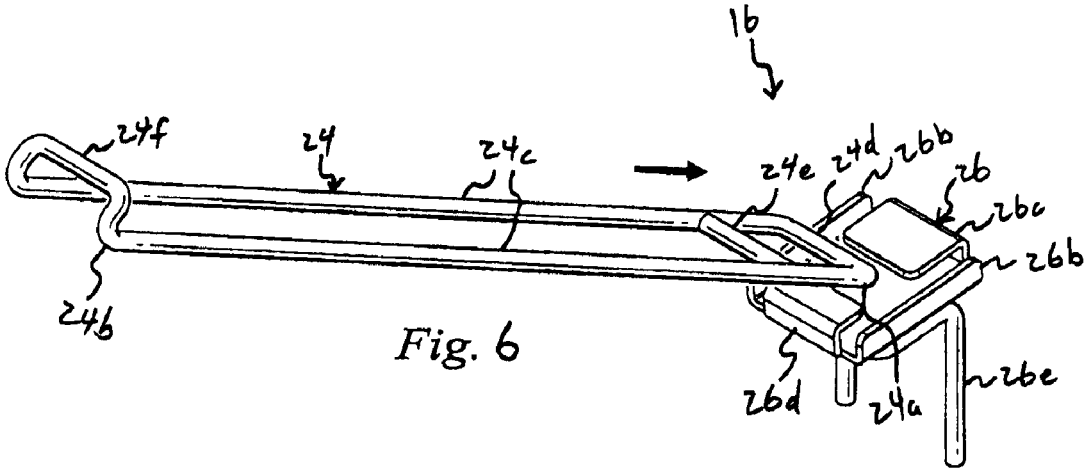
FIGS. 6-10 are perspective views, in series, of the hanger and latch of the gravity feed hanger assembly of FIG. 2 being coupled.
Figure 7:
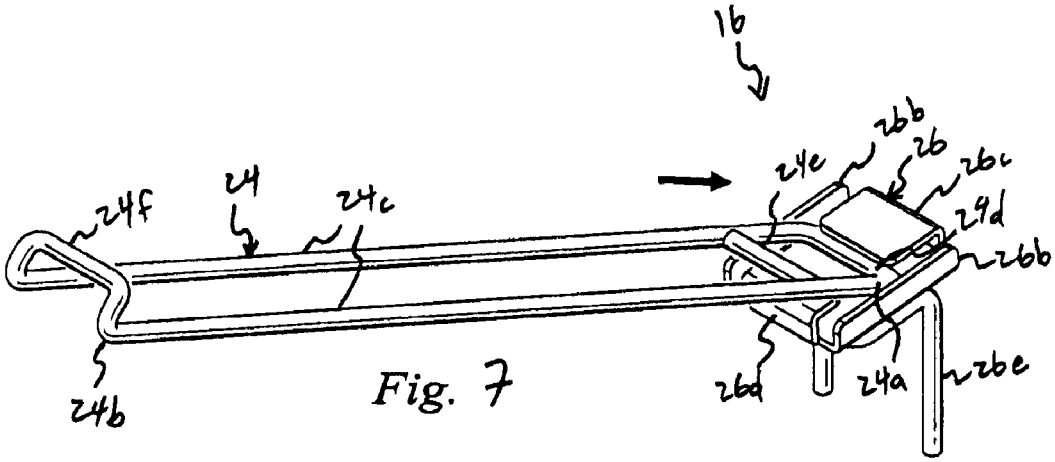
Figure 8:
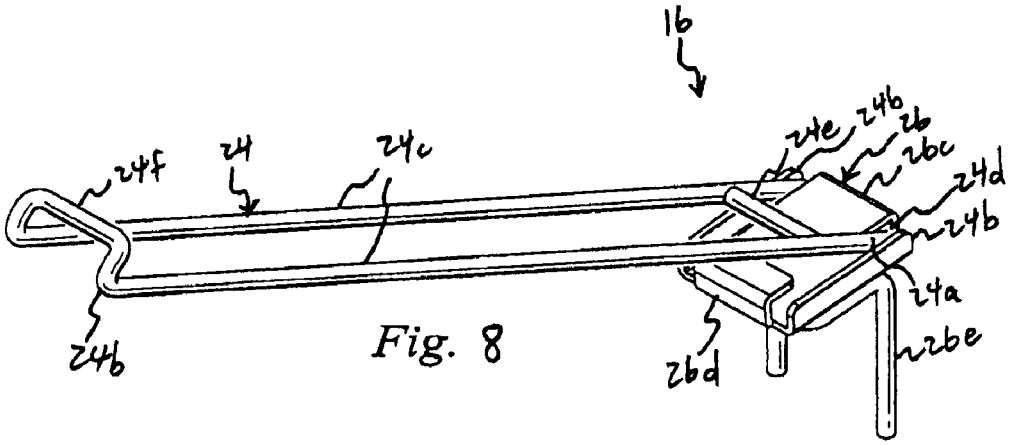
Figure 9:
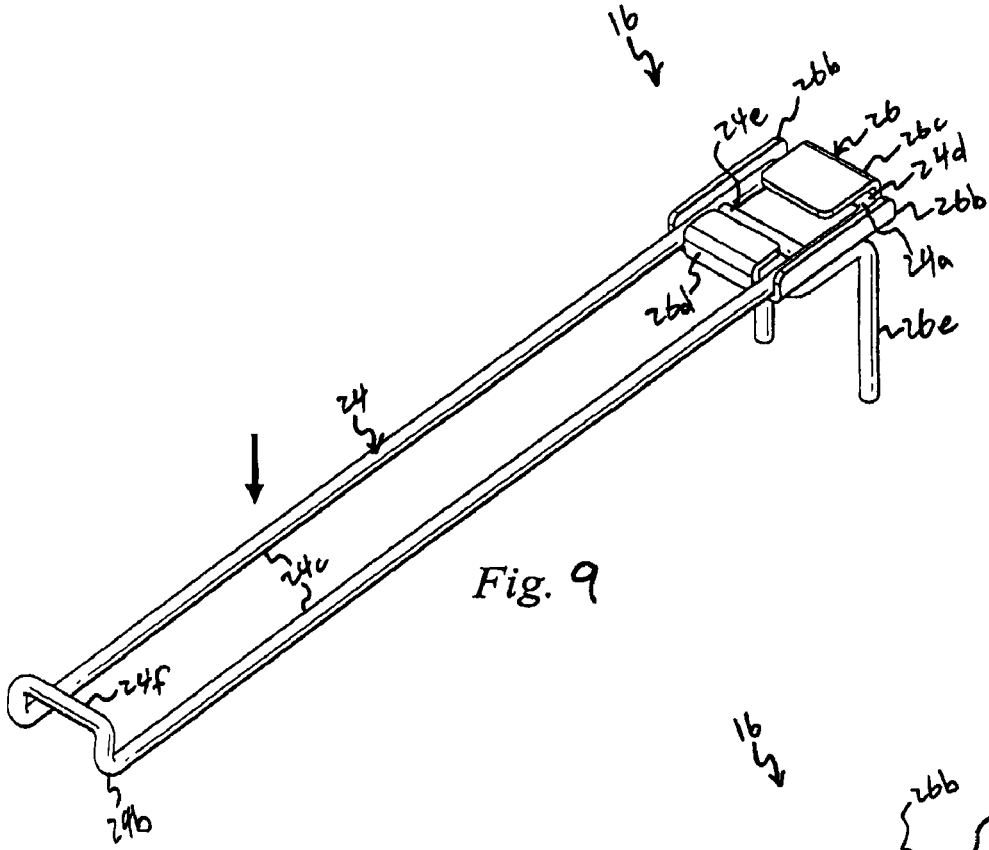

Operationally, the gravity feed system 10 is also suited to the time- and movement-efficient stocking, controlled dispensing and restocking of the hanging stock 14. Referring to FIGS. 4 and 5, the hanging stock 14 can provided in stock containers 30 that allow the hanging stock 14 to arrive at the point of sale in a condition such that the hanging stock 14 is aligned in the same configuration in which it will be displayed in the gravity feed system 10. In the embodiment shown, the hanger 24, decoupled from the latch 26, is threaded through the hanging stock tabs 22 of the hanging stock 14 via the slots 20. The loading end 24*a* of the hanger 24 is substantially linear and coplanar with the rest of the hanger 24, ensuring that multiple items of hanging stock 14 may be threaded onto the hanger 24 in one continuous motion. The entirety of the hanging stock 14 to be displayed and dispensed from the hanger 24 is then removed from the stock container 30 by exerting sufficient upward force on the hanger 24.

FIGS. 6-10 are perspective views of the hanger 24 and the latch 26 in a series, according to an aspect of the present disclosure, with continued reference to FIG. 3, and show the coupling of the hanger 24 to the latch 26. The endpiece 24*d* of the hanger is inserted into the gap between the load tab 26*c* and the restraining tab 26*b* so that it contacts the top face 26*aa* of the base 26*a*. The endpiece 24*d* is then slid toward the rear edge 26*ae* of the latch 26 (and, in the case of the embodiment displayed, upward, due to the downward angle at which the gravity feed hanger assembly 16 will rest) until the endpiece 24*d* also contacts the portion of the load tab 26*c* that is perpendicular to the base 26*a*. The hanger 24 is then rotated downward, about the endpiece 24*d*, so that the crosspiece 24*e* contacts the top face 26*aa* of the base 26*a* and the hanger 24 extends from the latch 26 along substantially the same plane as that defined by the top face 26*aa*. An outward (and, for this embodiment, downward) force is exerted on the hanger 24 so that it slides within the latch 26, in the direction of the front edge 26*ad*, and the crosspiece 24*e* contacts the portion of the restraining tab 26*d* that is perpendicular to the top face 26*aa*.

Thus coupled with the latch 26, as shown in FIGS. 10 and 11, the hanger 24 allows for the display and dispensing of the hanging stock 14. The latch 26 stabilizes the hanger 24 against most lateral, longitudinal, and even upward and downward movement. As the weight of the hanging stock 14, as well as that of the hanger 24 itself, exerts outward and downward forces on the hanger 24 that pin the crosspiece 24*e* against the load tab 26*c* and the top face 26*aa* of the latch 26, the crosspiece 24*e* acts as a fulcrum and translates the downward force exerted by the hanging stock 14 into an upward force that is exerted on the endpiece 24*d*. The endpiece 24*d* is held in place, and thus the hanger 24 is prevented from rotating about the crosspiece 24*e*, by the restraining tab 26*b*. The gap between the load tab 26*c* and the restraining tab 26*b* is sized to ensure that, in order to decouple the hanger 24 from the latch 26, the crosspiece 24*e* must be forced away from the horizontal portion of the restraining tab 26*b* and toward the gap between the restraining tab 26*b* and the load tab 26*c*.

Due to the downward angle at which the gravity feed hanger assembly 16, and thus the hanger 24, extends from the crossbeam 18 in the embodiment shown, the weight of the hanging stock 14 also tends to pull the hanging stock 14 down the length of the hanger 24, absent sufficient friction between the hanging stock tab 22 and the rods 24*c* to prevent slippage. In some embodiments, the hanger 24 may be powder-coated or otherwise treated with a friction-reducing product so as to facilitate the movement of the hanging stock 14 along the hanger 24. Such products may contain, for example, Teflon or materials with similar low-friction properties. One example of such material is the Sliptex powder coating manufactured by Prism Powder Coating Ltd. However, other materials are also within the scope of the present disclosure.

Despite the force exerted on the hanging stock 14 by its own weight, the lip 24*f* prevents the uncontrolled dispensing of hanging stock 14 by halting the progress of the foremost item of hanging stock 14 at the dispensing end 24*b* of the hanger 24. As shown in FIG. 12, the lip 24*f* is long enough and set at an angle sufficient to prevent the hanging stock 14 from being propelled off of the end of the hanger 24 by the force of its own weight, in combination with the cumulative weight of any of the hanging stock 14 that may be trailing behind it.

Figure 13:
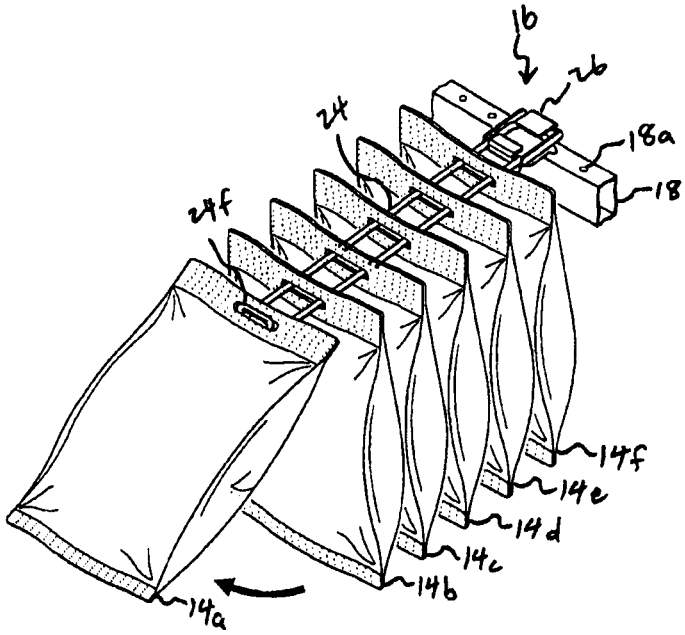
FIGS. 13-15 are perspective views, in series, of the removal of the hanging stock and the operation of the gravity feed system of FIG. 1.
Figure 14:
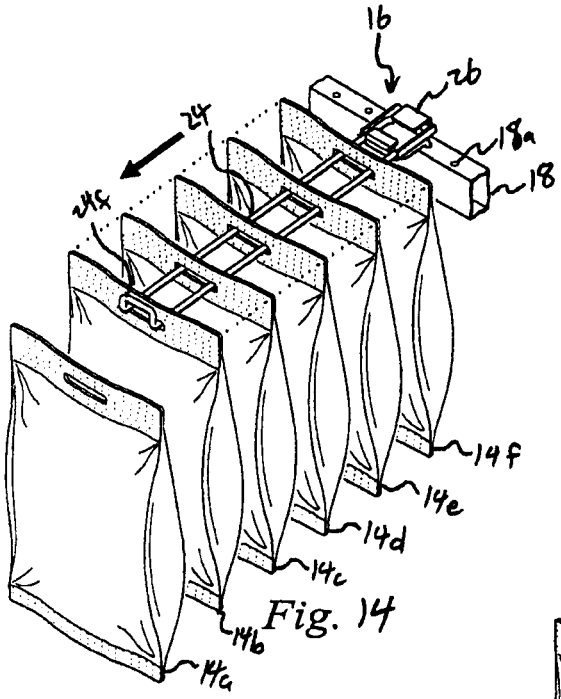
Figure 15:
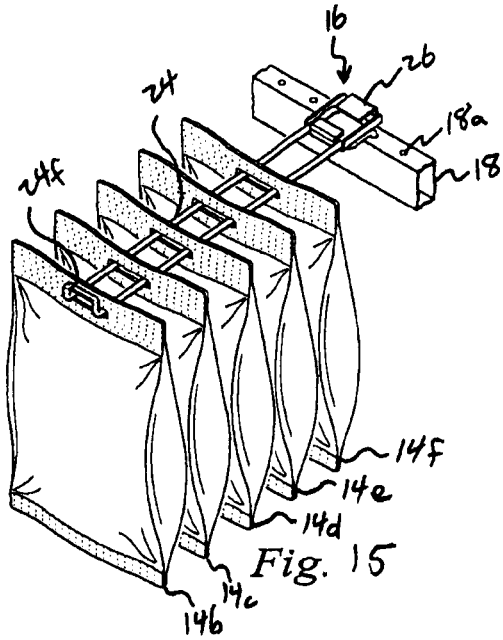

Controlled dispensing of the hanging stock 14 is performed by the manual removal of the hanging stock 14. In the embodiment illustrated in FIGS. 13-15, a foremost item 14*a* must be manipulated by the individual removing it so that it is pulled both outward and upward, clearing the lip 24*f*. As the item 14*a* vacates its position at the bottom of the hanger 24, trailing hanging stock 14*b*-14*f* are pulled downward, along the hanger 24, by their own weight. Once the hanging stock 14*a* has been removed entirely from the hanger 24, the hanging stock 14*b*, no longer impeded by the obstructing hanging stock 14*a*, is urged by its own weight to the end of the hanger 24 and is halted by the lip 24*f*. The hanging stock 14*c*-14*f* similarly move downward along the hanger 24, until each of the hanging stock 14*c*-14*f* is halted by the item in front of it, so that the length of the hanger 24 nearest the loading end 24*a* is vacated. As the remaining hanging stock 14*b*-*f* are similarly removed from the hanger 24, the space between the hanging stock 14*f* and the latch 26 increases until, finally, the hanging stock 14*f* is removed and the hanger 24 is emptied.

Restocking of the gravity feed system, which can be performed whether or not hanging stock 14 is already threaded on the hanger 24, requires that the hanger 24 be decoupled from the latch 26. To accomplish this, the hanger 24 is manipulated in reverse order of the steps described above for coupling the hanger 24 to the latch 26, as depicted in FIGS. 6-10 (also taken in reverse order of presentation). A force is exerted on the hanger 24 so that the crosspiece 24*e* and endpiece 24*d* slide within the latch 26 and the endpiece 24*d* contacts the horizontal portion of the load tab 26*c* of the latch 26. The hanger 24 is then rotated about the endpiece 24*d* so that the cross piece is lifted clear of the face and passes through the gap between the load tab 26*c* and the restraining tab 26*b*. The hanger 24 may then be moved so that the endpiece 24*d* slides within the latch 26 and emerges in the gap between the load tab 26*c* and the restraining tab 26*b*, at which point the hanger 24 may be moved away from the latch 26 so that the endpiece 24*d* passes between the load tab 26*c* and the restraining tab 26*b* and the hanger 24 is separated from the latch 26.

Once the hanger 24 is decoupled from the latch 26, the previously described technique for loading the hanger 24 with hanging stock 14 is repeated in order to restock the hanger 24. In the event that all hanging stock 14 previously loaded on the hanger 24 has been removed (via the dispensing end 24*b* of the hanger 24), an entirely new set of hanging stock 14 is threaded onto the hanger 24 for display and dispensing. If hanging stock 14 from the last loading task remains on the hanger 24, fewer items of the hanging stock 14 may be loaded, but the technique for loading the hanger 24 does not change.

As loading end 24*a* of the hanger 24 is the end at which the newer hanging stock 14 is loaded onto the hanger 24, the older hanging stock 14, which already resides on the hanger 24, will necessarily be placed at the fore of the gravity feed system once the hanger 24 is recoupled with the latch 26. The configuration of the hanger 24 and the loading technique employed with it thus addresses a problem commonly encountered in the display and sale of consumer goods via conventional display systems: the presentation of goods so that older items are presented to customers and newer items are not constantly placed at the fore of the display, ensuring cycling of inventory. Utilizing the rear-loading technique demonstrated by the embodiment shown in FIG. 4, an individual performing a restocking task need not reposition or remove older inventory prior to inserting newer inventory into a display. The threading movement described above automatically places newer inventory at the rear of each hanger 24 and presents the older inventory to the customer, eliminating an entire subset of movements normally involved in restocking tasks.

The hanger 24 and latch 26 can be fabricated of any material that is consistent with the uses described above. For example, each of the hanger 24 and the latch 26 could be fabricated from one or more plastic or metal materials. Also, the latch 26 could be fabricated from a plastic material and the housing could be fabricated from a metal, or vice versa.

Figure 16:
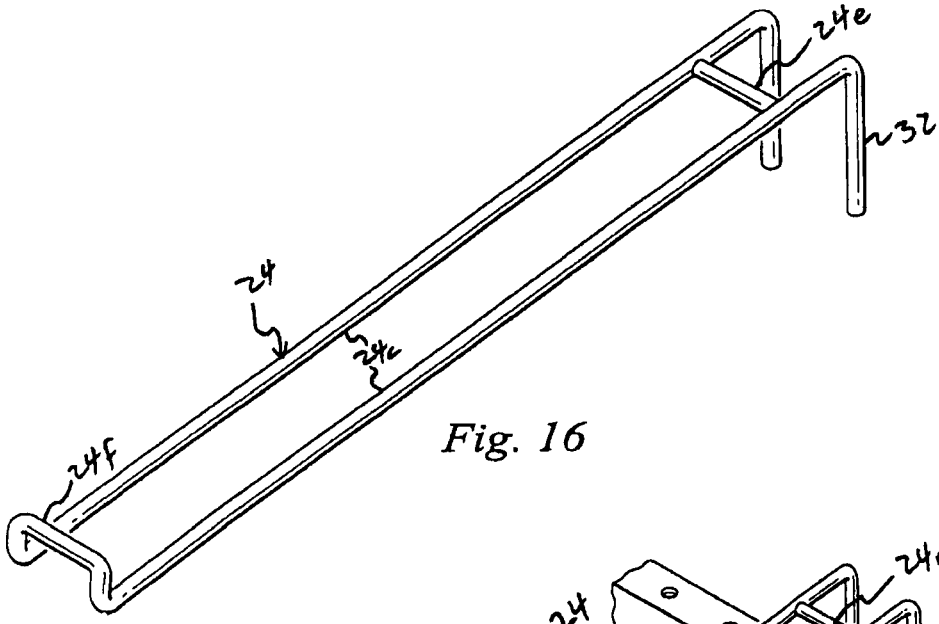
FIG. 16 is a perspective view of a hanger according to one embodiment of the present disclosure.
Figure 17:
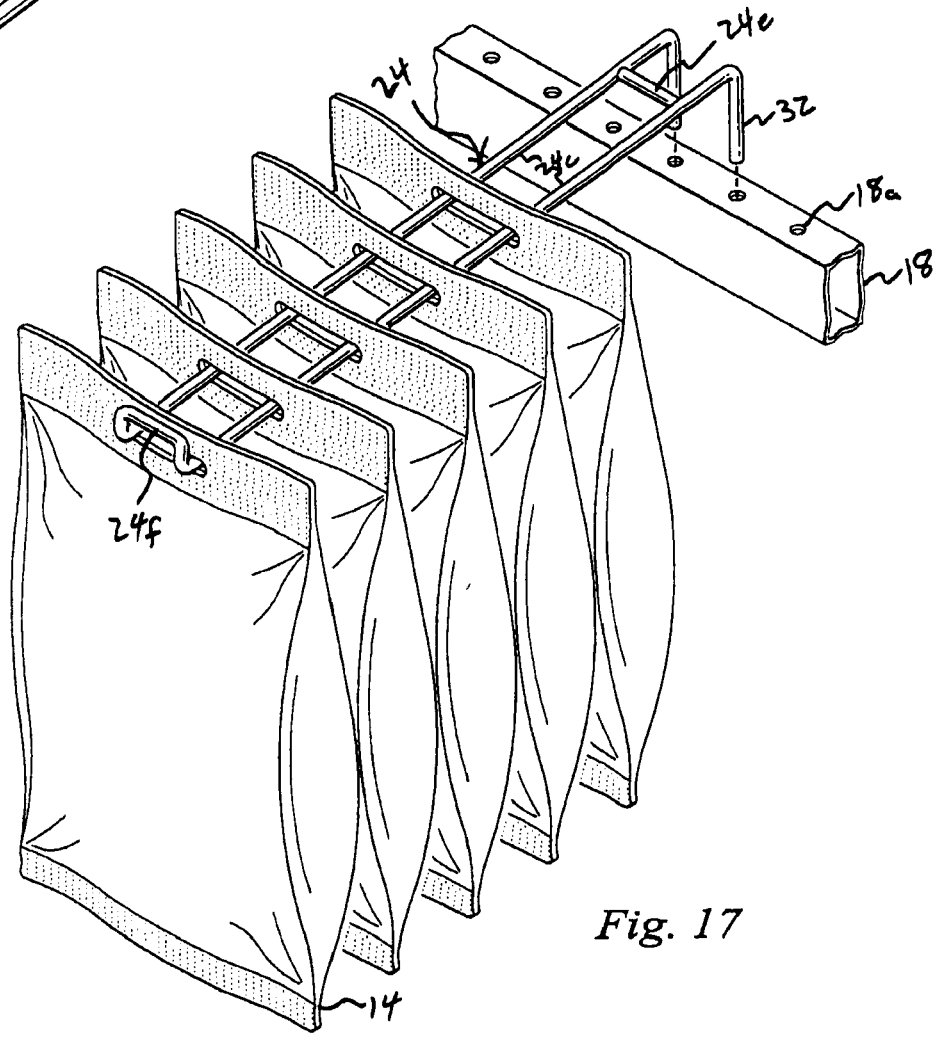
FIG. 17 is a perspective view of the hanger of FIG. 16 loaded with hanging stock.

Variations may be made in the foregoing without departing from the scope of the invention. For instance, the embodiment shown in FIGS. 16 and 17 incorporates integral mounting members 32 into the hanger 24, allowing for adjustment of the position of the hanger 24 along the crossbeam 18 every time the hanger 24 is decoupled from the crossbeam 18.

Figure 18:
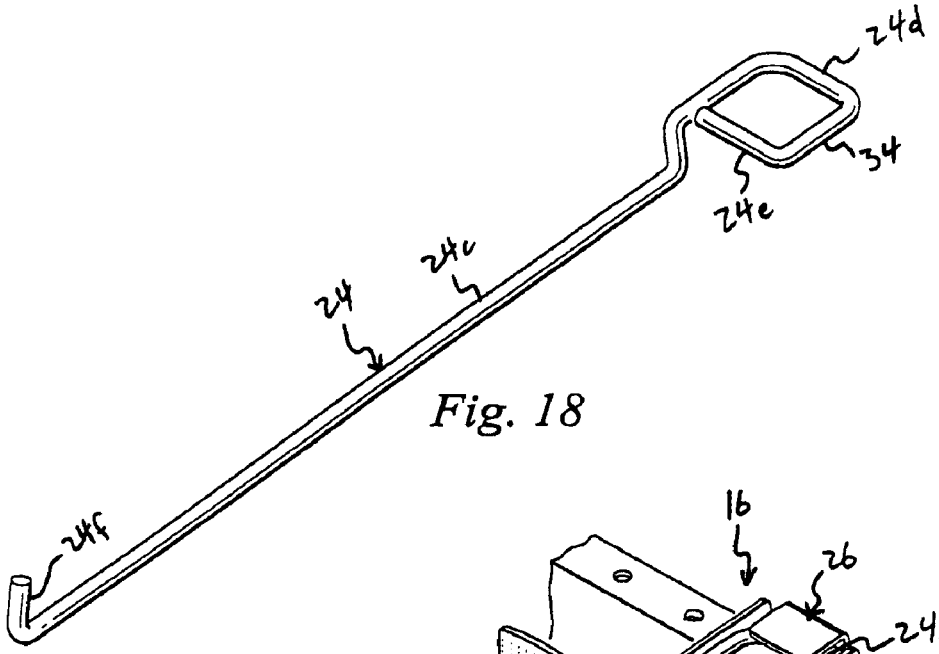
FIG. 18 is a perspective view of a hanger according to one embodiment of the present disclosure.
Figure 19:
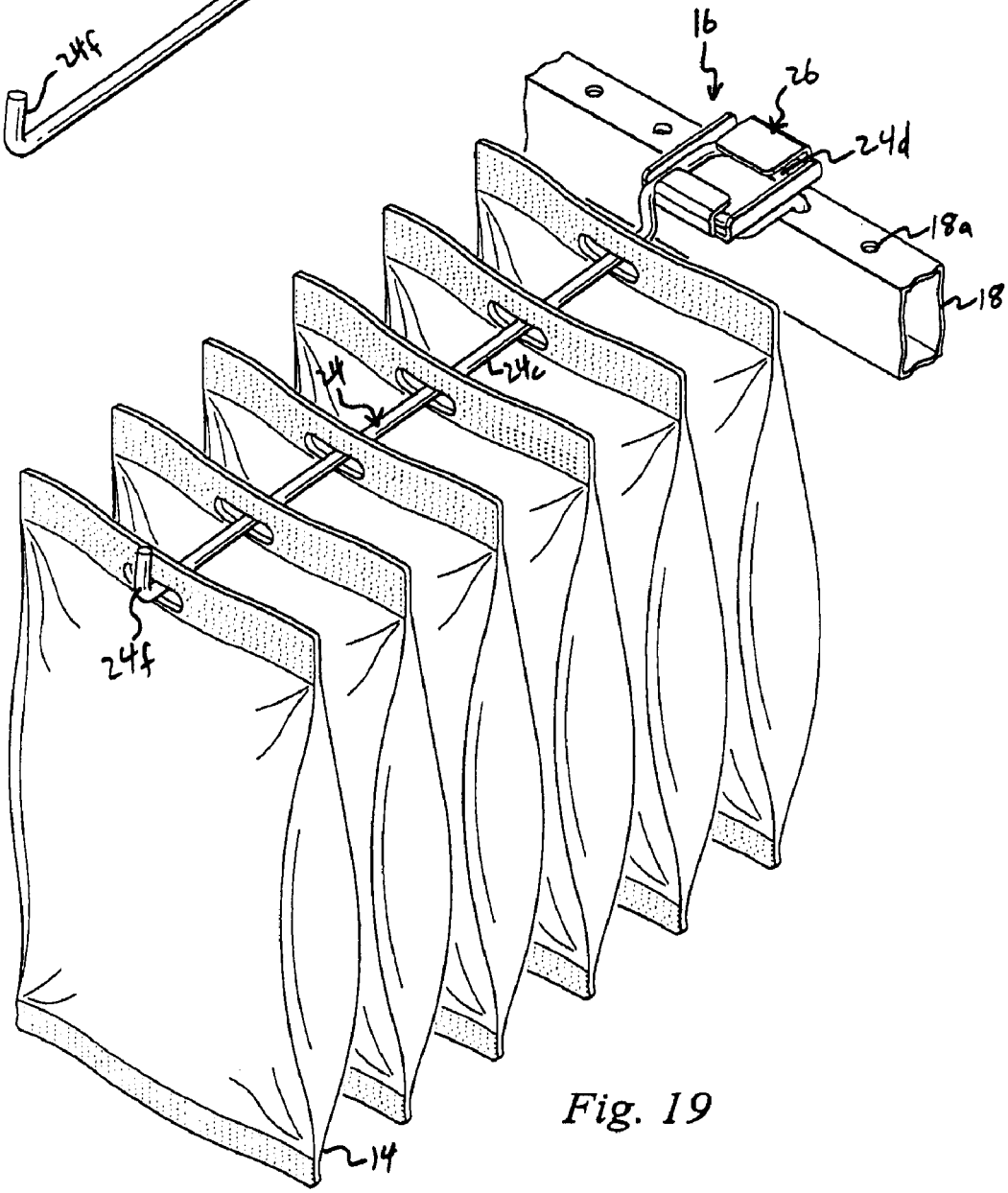
FIG. 19 is a perspective view of the hanger of FIG. 18 loaded with hanging stock.

Another embodiment, illustrated in FIGS. 18 and 19, possesses only a single rod 24*c* for the display of smaller or lighter hanging stock 14. The crosspiece 24*e* and endpiece 24*d* of this modified version of the hanger 24 are joined by a connecting rod 34, but perform the same functions as their counterparts in the embodiment described in detail above and illustrated in FIGS. 1-15. In some versions of this embodiment, crosspiece 24*e*, endpiece 24*d* and connecting rod 34 may be formed from the same continuous member as the rod 24*c*.

Figure 20:
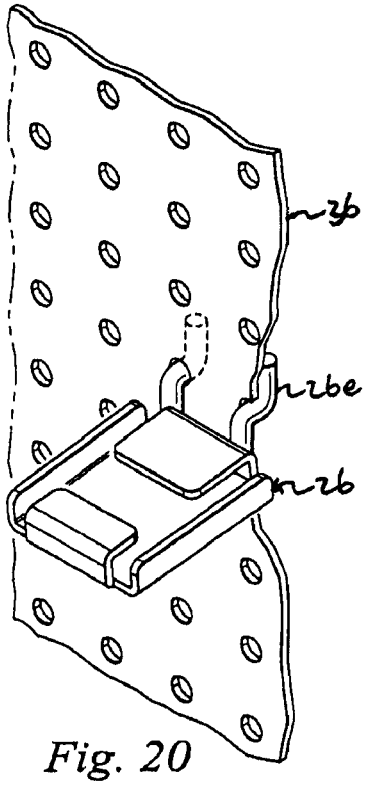
FIG. 20 is a partial perspective and partial sectional view of a latch according to one embodiment of the present disclosure.

A further embodiment of the gravity feed hanger assembly includes a modified latch 26, shown in FIG. 20, that is configured to be coupled to a vertical, rather than a horizontal, surface 36. In some such embodiments, the mounting members 26*e* may extend to the rear of the latch 26 and are suitable for use with a pegboard, such as a standard 2" center layout.

Figure 21:
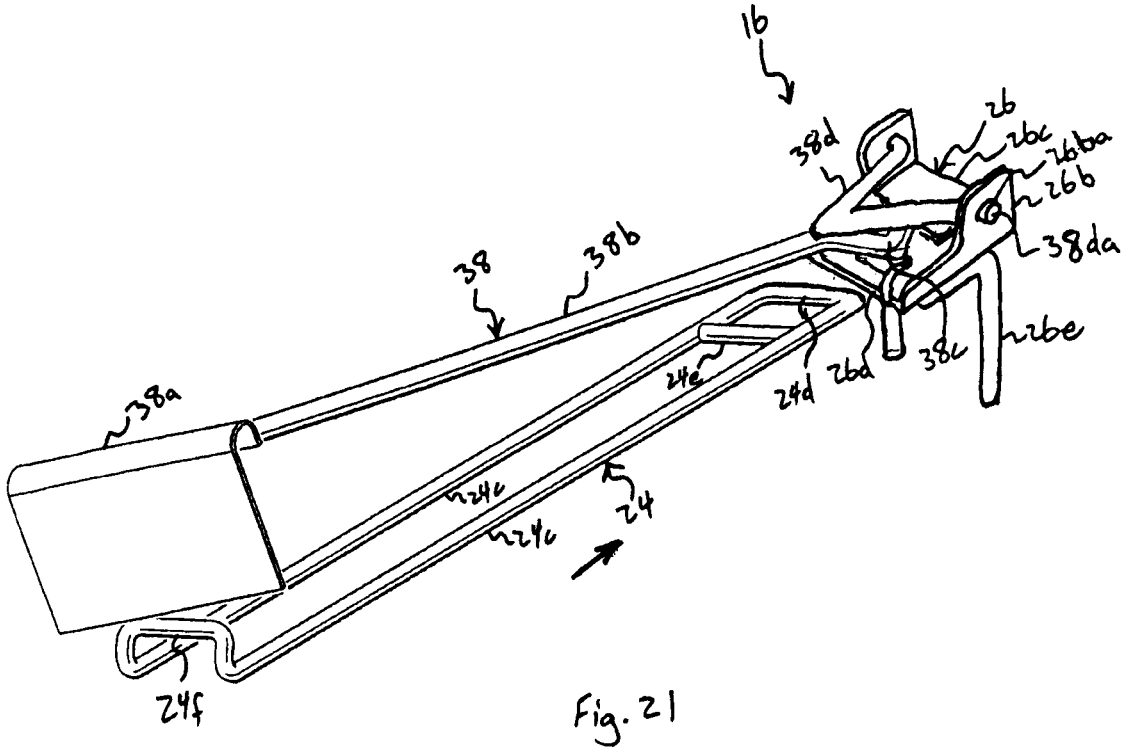
FIG. 21 is a perspective view of a gravity feed hanger assembly bearing a barcode display according to one embodiment of the present disclosure.
Figure 22:
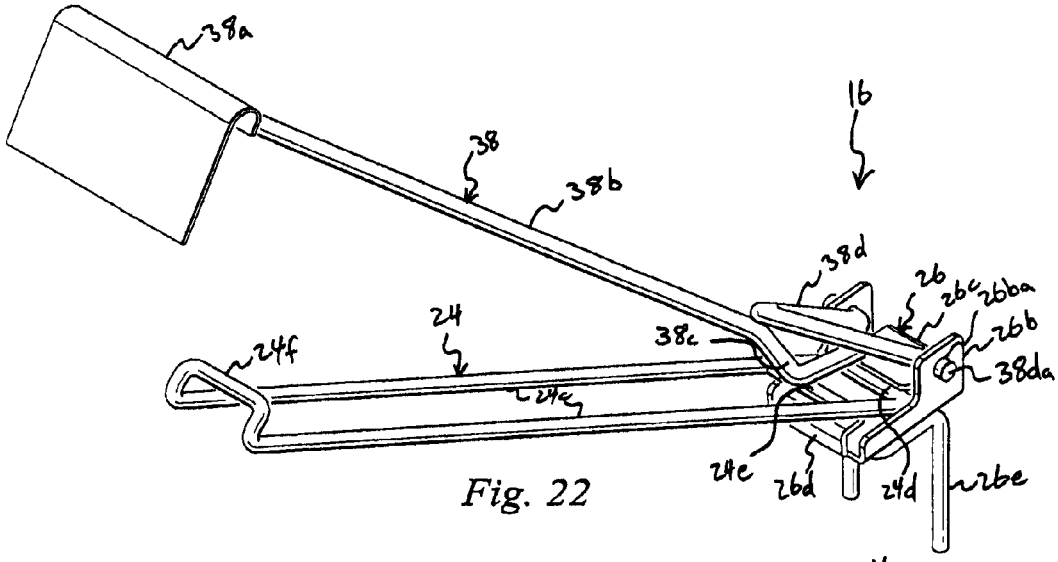
FIG. 22 is a perspective view of the actuated barcode display of FIG. 21.
Figure 23:
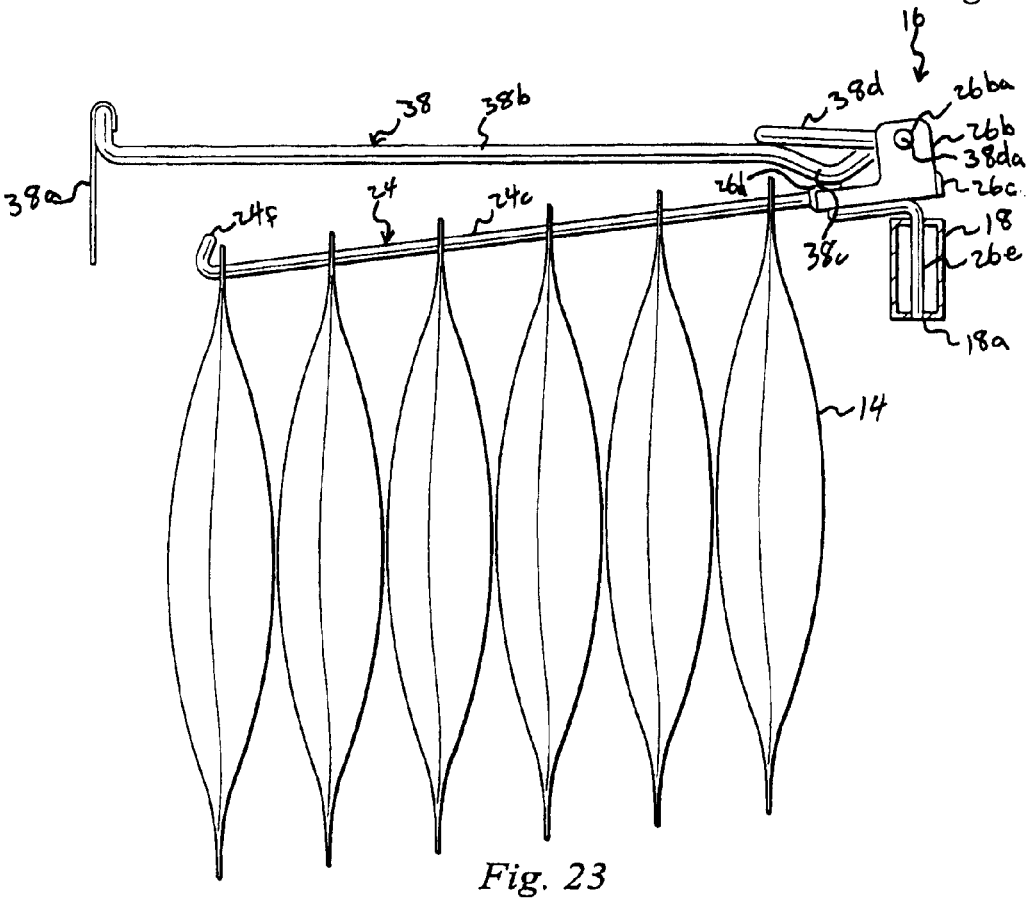
FIG. 23 is a side elevation of the gravity feed hanger assembly of FIG. 21.

In yet other embodiments, such as that illustrated in FIGS. 21-23, the gravity feed hanger assembly 16 includes the additional element of a barcode display 38. The barcode display member 38 includes a barcode mount 38*a* that is attached to a barcode rod 38*b*. The barcode mount 38*a* may be integral to the barcode rod 38*b* or removably coupled to the barcode rod 38*b*. The end of the barcode rod 38*b* opposite the barcode mount 38*a* includes a prop point 38*c*, which angles downward and then back upward, ending generally at the plane defined by the barcode rod 38*b*. This embodiment further includes a generally V-shaped hinge 38*d*, the apex of which joins the barcode display 38 at the joint between the barcode rod 38*b* and the prop point 38*c*. The hinge 38*d* is substantially parallel to the barcode rod 38*b*. Pivot members 38*da* extend from the ends of the hinge 38*d* in directions opposite one another and perpendicular to the barcode rod 38*b*. In some such embodiments, portions of the side tabs 26*b* of the latch 26 are enlarged and voids 26*ba* are formed therein to receive the pivot members 38*da*. When coupled with the latch 26 and in its resting position, the barcode display 38 is propped up at an angle that is substantially horizontal by the engagement of the prop point 38*c* with the top of the restraining tab 26*d*, as shown in FIG. 23.

In such embodiments, the hanger 24 may be coupled with and decoupled from the latch 26 in the manner described in detail above, despite the presence of the barcode display 38. As the loading end 24*a* of the hanger 24 approaches the gap between the load tab 26*c* and the restraining tab 26*b*, the endpiece 24*d* contacts the front of the prop point 38*c*, as shown in FIG. 21. As the hanger 24 is moved closer to and inserted into the latch 26, the angle of the prop point 38*c* translates the force exerted by the endpiece 24*d* into upward movement of the barcode display 38, which rotates about the hinge 38*d* to create clearance between the prop point 38*c* and the restraining tab 26*d* for the endpiece 24*d*, as shown in FIG. 22. Once the endpiece 24*d* clears the prop point 38*c*, the barcode display 38 lowers back to its resting point and the endpiece 24*d* enters the gap between the load tab 26*c* and the restraining tab 26*b*. This process is repeated as the crosspiece 24*e* of the hanger 24 similarly enters the latch 26 and contacts the prop point 38*c*, so that the hanger 24 is coupled with the latch 26 and the gravity feed hanger assembly 16 is fully assembled and installed.

The hanger 24 is similarly detached from the latch 26 in this embodiment in the manner described in detail above. As the loading end 24*a* of the hanger 24 is removed from the latch 26 the crosspiece 24*e* and the endpiece 24*d*, in turn, are pressed against the back of the prop point 38*c* and force the barcode display 38 upward. During both the insertion and the removal of the hanger 24, the natural gripping position of the user's arm or hand may result in contact with and assistance in actuating the barcode display 38.

Figure 24:
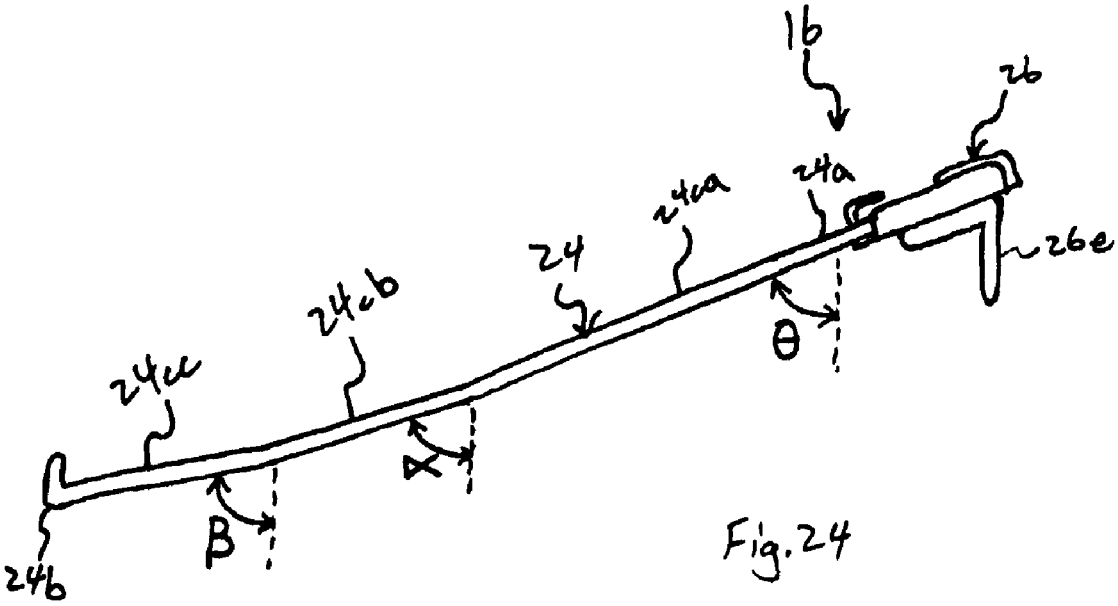
FIG. 24 is a side elevation of a gravity feed hanger assembly including a varied-angle hanger according to one embodiment of the present disclosure.

In still other embodiments, such as that depicted in FIG. 24, the gravity feed hanger assembly 16 is similar to the gravity feed hanger assembly 16 depicted in FIGS. 1-15 and contains substantially the same parts, which are given the same reference numerals. These embodiments of the gravity feed hanger assembly 16 include a non-linear hanger 24 which includes sections 24*ca*, 24*cb* and 24 cc, each of which is substantially linear. The section 24*ca* extends substantially half of the length of the hanger 24, from the loading end 24*a* toward the center of the hanger 24, at an angle that is less than horizontal. The angle θ between the mounting members 26*e* and the hanger 24 is thus less than 90 degrees. The section 24*cb* extends from the section 24*ca*, toward the dispensing end 24*b* of the hanger 24, at a less steep angle than that of the section 24*ca*, so that an angle ά between the section 24*cb* and the mounting members 26*e* is greater than the angle θ. The section 24 cc extends from the section 24*cb*, and forms the dispensing end 24*b* of the hanger 24, at less steep angle than that of the section 24*cb*, so that an angle β between the section 24 cc and the mounting members 26*e* is greater than the angle ά. As described above, the hanging stock 14 are subjected to a constant downward force that pulls them along the hanger 24, toward the dispensing end 24*b*. The structure of the hanger 24 in the embodiment shown in FIG. 24 reduces the amount of force exerted on the foremost items of hanging stock 14 by trailing items of the hanging stock 14 near the dispensing end 24*b* of the hanger 24 by diminishing the potential for movement along the hanger 24 due to gravity.

Although only a few exemplary embodiments of this invention have been described in detail above, those skilled in the art will readily appreciate that many other modifications are possible in the exemplary embodiments without materially departing from the novel teachings and advantages of this invention. Accordingly, all such modifications are intended to be included within the scope of this invention as defined in the following claims.

What is claimed is:

1. An apparatus, comprising:

a latch comprising a base having a face; and a hanger detachably coupled to the latch wherein the hanger extends at an angle that is equal to or less than horizontal;

wherein the hanger includes a first end of the hanger that allows an item to be threaded onto the hanger and a second end of the hanger that includes tip that retains the item on the hanger;

wherein the first end of the hanger is substantially linear and substantially coplanar with the face of the latch;

wherein the hanger comprises a member that extends horizontally and engages the latch to secure the hanger within the latch when the hanger and the latch are coupled;

wherein the latch comprises a restraining tab extending upward from the front edge of the base and a load tab extending upward from the rear of the base; said restraining tab being bent to extend horizontally over a portion of the base; wherein the restraining tab engages the member and secures the hanger within the latch when the hanger and the latch are coupled.

2. The apparatus of claim 1 wherein the tabs prevent vertical movement of the hanger when the hanger and the latch are coupled.

3. The apparatus of claim 1 wherein the latch comprises side tabs that extend upward from the side edges of the base that engage the hanger and prevent lateral movement of the hanger when the hanger and the latch are coupled.

4. The apparatus of claim 1 wherein the hanger comprises two substantially parallel hanger rods.

5. The apparatus of claim 1 where in the hanger includes a friction-reducing coating.

6. The apparatus of claim 5 wherein the friction-reducing coating contains Teflon.

7. The apparatus of claim 1 wherein the latch comprises a mounting member wherein said mounting member extends vertically through a support member configured to removably couple the latch to said support member.

8. The apparatus of claim 1 further comprising a display member coupled to the latch.

9. The apparatus of claim 8 wherein the display member is hingedly coupled to the latch.

10. The apparatus of claim 1 wherein the hanger is coupled with and decoupled from the latch by manipulating the hanger as the latch remains coupled to a support member.

11. The apparatus of claim 1 wherein the distal tip extends from the hanger in a direction that is substantially vertical.

12. The apparatus of claim 1 wherein the hanger extends at an angle that is less than horizontal.

13. An apparatus, comprising:

a latch comprising:

a face;

two side tabs, each side tab comprising a substantially vertical portion;

a load tab comprising a substantially horizontal portion and a substantially vertical portion;

a restraining tab comprising a substantially horizontal portion and a substantially vertical portion; and two mounting members; and a hanger detachably coupled to the latch wherein the hanger and the face are substantially coplanar and the hanger extends at an angle that is equal to or less than the horizontal, the hanger comprising:

two substantially parallel hanger rods, each hanger rod engaging one of the side tabs so that lateral movement of the hanger is prevented when the hanger and the latch are coupled;

a first end that is substantially linear and coplanar with a central portion of the hanger;

a second end comprising a lip that joins the hanger rods and extends from the hanger at an angle that is substantially vertical so that the lip retains items that are threaded onto the hanger via the first end;

an endpiece that joins the hanger rods at the first end and engages the load tab so that the hanger is secured within the latch and is prevented from moving vertically and longitudinally when the hanger and the latch are coupled;

a crosspiece that extends between the hanger rods proximal to the first end and engages the restraining tab so that the hanger is prevented from moving vertically and longitudinally when the hanger and the latch are coupled; and a friction-reducing coating.

14. The apparatus of claim 13 further comprising:

a substantially vertical member; and a substantially horizontal member adjustably coupled to the vertical member and to which the latch is detachably coupled, the horizontal member comprising a linear array of vertically oriented receptacles formed therein;

wherein the receptacles engage the mounting members when the latch is coupled to the horizontal member.

15. An apparatus, comprising:

a substantially vertical member;

a substantially horizontal member comprising a substantially vertically oriented receptacle;

a latch comprising:

a face;

a pair of latitudinal tabs;

a pair of longitudinal tabs; and a mounting member; and a hanger comprising:

two substantially parallel hanger rods;

a substantially vertical upward lip joining the hanger rods at a first end of the hanger;

an endpiece joining the hanger rods at a second end of the hanger; and a crosspiece extending between the hanger rods at a point between the first end and the second end;

wherein the horizontal member is removably coupled to the vertical member;

wherein the latch is removably coupled to the horizontal member by an engagement of the mounting member with the receptacle;

wherein the latitudinal tabs engage the endpiece and the crosspiece and removably couple the hanger to the latch;

wherein the longitudinal tabs engage the hanger rods and prevent lateral movement of the hanger; and wherein the hanger extends from the latch along a plane that is parallel to that of the face of the latch and at an angle that is less than horizontal.

* * * * *